US007127399B2

(12) United States Patent
Hama et al.

(10) Patent No.: US 7,127,399 B2
(45) Date of Patent: Oct. 24, 2006

(54) VOICE PROCESSING METHOD AND VOICE PROCESSING DEVICE

(75) Inventors: Toyokazu Hama, Yokosuka (JP); Nobuhiko Naka, Yokohama (JP)

(73) Assignee: NTT DoCoMo, Inc., Tokyo (JP)

( * ) Notice: Subject to any disclaimer, the term of this patent is extended or adjusted under 35 U.S.C. 154(b) by 242 days.

(21) Appl. No.: 09/860,881

(22) Filed: May 18, 2001

(65) Prior Publication Data

US 2002/0013696 A1 Jan. 31, 2002

(30) Foreign Application Priority Data

May 23, 2000 (JP) ..... 2000-151880

(51) Int. Cl.
*G10L 21/00* (2006.01)

(52) U.S. Cl. ..... 704/270.1; 704/220; 704/500; 704/502; 704/503; 370/331; 370/410

(58) Field of Classification Search ..... 714/795, 714/755, 704, 751; 348/385.1; 704/230, 704/227–228, 500–504, 270.1; 370/331
See application file for complete search history.

(56) References Cited

U.S. PATENT DOCUMENTS

| | | | | |
|---|---|---|---|---|
| 5,113,400 | A * | 5/1992 | Gould et al. | 714/795 |
| 5,682,416 | A * | 10/1997 | Schmidt et al. | 455/436 |
| 5,918,205 | A * | 6/1999 | Dierke | 704/230 |
| 5,925,146 | A | 7/1999 | Murata et al. | |
| 5,956,331 | A | 9/1999 | Rautiola et al. | |
| 5,987,631 | A * | 11/1999 | Kong | 714/704 |
| 6,012,024 | A * | 1/2000 | Hofmann | 704/219 |
| 6,154,866 | A * | 11/2000 | Kawahara et al. | 714/755 |
| 6,330,365 | B1 | 12/2001 | Yasuda et al. | |
| 6,349,197 | B1 * | 2/2002 | Oestreich | 455/63.1 |
| 6,357,028 | B1 * | 3/2002 | Zhu | 714/751 |
| 6,466,556 | B1 * | 10/2002 | Boudreaux | 370/331 |
| 6,519,004 | B1 * | 2/2003 | Bahl | 348/385.1 |
| 6,522,655 | B1 * | 2/2003 | Laiho | 370/410 |
| 6,567,475 | B1 * | 5/2003 | Dent et al. | 375/286 |
| 6,714,908 | B1 | 3/2004 | Naka | |

FOREIGN PATENT DOCUMENTS

| | | |
|---|---|---|
| EP | 0 998 164 A1 | 5/2000 |
| WO | WO 99/05830 | 2/1999 |
| WO | WO 99/14866 | 3/1999 |
| WO | WO 99/31911 | 6/1999 |

* cited by examiner

*Primary Examiner*—Richemond Dorvil
*Assistant Examiner*—Qi Han
(74) *Attorney, Agent, or Firm*—Brinks Hofer Gilson & Lione

(57) ABSTRACT

In a voice communication system 1, a gateway server 4 receives IP packets from the Internet, converts PCM voice data in the IP packets into AMR encoded voice data frames, and transmits to a mobile terminal 7. During the propagation to the gateway server 4, there is a possibility of loss of IP packets and crucial bit error in IP packets. In that case, the gateway server 4 puts "No data" data on frames as voice encoded data for the IP packets in question and sends it to the mobile terminal 7. The "No data" data is a target of concealment.

4 Claims, 6 Drawing Sheets

VOICE PROCESSING METHOD AND VOICE PROCESSING DEVICE

BACKGROUND OF THE INVENTION

1. Field of the Invention

The present invention relates to voice processing method and voice processing device suitable for real time voice communication system.

2. Prior Art

Real time voice communication such as telephone is usually carried out by connecting users' terminals with line and transmitting voice signal on the line. However, today with well-developed network such as the Internet, study of real time voice packet communication such as Internet telephone, in which voice signals are encoded and voice packets with the encoded signal on their payload parts are transmitted, is widely being done.

As a method for real time voice packet communication, following method is known. Namely, by a device at a transmitting side, voice signal is compressed using a certain method such as A-law or μ-law, then sampled, and PCM (pulse code modulation) voice sampling data is generated. The PCM voice sampling data is then placed on the payload part of the voice packet, and transmitted to a device at a receiving side via network. However, when this method is used, if voice packet is lost by network congestion, or if bit error occurs in voice packet during propagation, the device at the receiving side cannot reproduce voice for that faulty voice packet. This can result in degradation of voice quality.

Also, so far, a decoder and an error detection device do not send to the following encoder information that there is loss of packet or bit error in packet. Therefore, the encoder encodes these defective packets without taking any measures against defection. This results in degradation in voice quality.

SUMMARY OF THE INVENTION

The present invention is made under the above-mentioned circumstance. An object of the invention is to provide voice processing method and voice processing device that make it possible to receive or relay voice data by keeping good communication quality even under a bad circumstance where packet loss or bit error occurs during packet propagation of voice data via network.

Another object of the present invention is achieved by providing a voice processing method comprising: receiving a first stream of encoded voice data via a network; detecting loss or bit error of the encoded voice data from the first stream; decoding the encoded voice data to generate a voice signal; and generating a second stream which includes encoded voice data of the voice signal for a section of the first stream from which loss or bit error of the encoded voice data is not detected, and includes a not-encoded data for a section of the first stream from which loss or bit error of the encoded voice data is detected.

A further object of the present invention is achieved by providing a voice processing method comprising: receiving a first stream of encoded voice data via a network; detecting loss or bit error of the encoded voice data from the first stream; decoding the encoded voice data to generate a voice signal; encoding the voice signal to generate second encoded voice data; and outputting a second stream which includes the second encoded voice data wherein identification numbers are assigned only to the second encoded voice data for a section of the first stream from which loss or bit error of the encoded voice data is not detected; wherein lack of the identification number means that error-concealment should be carried out.

Still another object of the present invention is achieved by providing a voice processing method comprising: receiving a first stream of encoded voice data via a network; detecting loss or bit error of the encoded voice data from the first stream; decoding the encoded voice data to generate a voice signal; encoding the voice signal to generate second encoded voice data; and outputting a second stream which includes the second encoded voice data only for a section of the first stream from which loss or bit error of the encoded voice data is not detected.

An even further object of the present invention is achieved by providing a voice processing method comprising: receiving a first stream of encoded voice data via a network; receiving a first stream of encoded voice data via a network; detecting loss or bit error of the encoded voice data from the first stream; decoding the encoded voice data to generate a voice signal; and outputting a second stream of encoded voice data by encoding the voice signal for a section of the first stream from which loss or bit error of the encoded voice data is not detected, and by, for a section of the first stream from which loss or bit error of the encoded voice data is detected, performing concealment to compensate voice signal and encoding the compensated voice signal.

Yet another object of the present invention is achieved by providing a voice processing device comprising: a receiving mechanism that receives a first stream of encoded voice data via a network; a receiving mechanism that receives a first stream of encoded voice data via a network; a detecting mechanism that detects loss or bit error of the encoded voice data from the first stream; a decoding mechanism that decodes the encoded voice data to generate a voice signal; and a generating mechanism that generates a second stream which includes encoded voice data of the voice signal for a section of the first stream from which loss or bit error of the encoded voice data is not detected, and includes a not-encoded data for a section of the first stream from which loss or bit error of the encoded voice data is detected.

Another object of the present invention is achieved by providing a voice processing device comprising: a receiving mechanism that receives a first stream of encoded voice data via a network; a detecting mechanism that detects loss or bit error of the encoded voice data from the first stream; a first decoding mechanism that decodes the encoded voice data to generate a voice signal; and an outputting mechanism that output a second stream of encoded voice data by encoding the voice signal for a section of the first stream from which loss or bit error of the encoded voice data is not detected, and by, for a section of the first stream from which loss or bit error of the encoded voice data is detected, performing concealment to compensate voice signal and encoding the compensated voice signal.

A further object of the present invention is achieved by providing a program for making a computer to execute voice processing comprising: receiving a first stream of encoded voice data via a network; detecting loss or bit error of the encoded voice data from the first stream; decoding the encoded voice data to generate a voice signal; and generating a second stream which includes encoded voice data of the voice signal for a section of the first stream from which loss or bit error of the encoded voice data is not detected, and includes a not-encoded data for a section of the first stream from which loss or bit error of the encoded voice data is detected.

A still further object of the present invention is achieved by providing a computer readable storage media storing a program for making a computer to execute voice processing comprising: receiving a first stream of encoded voice data via a network; detecting loss or bit error of the encoded voice data from the first stream; decoding the encoded voice data to generate a voice signal; and generating a second stream which includes encoded voice data of the voice signal for a section of the first stream from which loss or bit error of the encoded voice data is not detected, and includes a not-encoded data for a section of the first stream from which loss or bit error of the encoded voice data is detected.

A further object of the present invention is achieved by providing a program for making a computer to execute voice processing comprising: receiving a first stream of encoded voice data via a network; detecting loss or bit error of the encoded voice data from the first stream; decoding the encoded voice data to generate a voice signal; and outputting a second stream of encoded voice data by encoding the voice signal for a section of the first stream from which loss or bit error of the encoded voice data is not detected, and by, for a section of the first stream from which loss or bit error of the encoded voice data is detected, performing concealment to compensate voice signal and encoding the compensated voice signal.

A still further object of the present invention is achieved by providing a computer readable storage media storing a program for making a computer to execute voice processing comprising: receiving a first stream of encoded voice data via a network; detecting loss or bit error of the encoded voice data from the first stream; decoding the encoded voice data to generate a voice signal; and outputting a second stream of encoded voice data by encoding the voice signal for a section of the first stream from which loss or bit error of the encoded voice data is not detected, and by, for a section of the first stream from which loss or bit error of the encoded voice data is detected, performing concealment to compensate voice signal and encoding the compensated voice signal.

The present invention can be embodied so as to produce or sell voice processing device for processing voice in accordance with the voice processing method of the present invention. Furthermore, the present invention can be embodied so as to record the program that executes the voice processing method of the present invention on storage media readable by computers, and deliver the media to users, or provide the program to users through electronic communication circuits.

DESCRIPTION OF THE PREFERRED EMBODIMENTS

With reference to the drawings, embodiments of the present invention will be described. However, the present invention is not limited to the following embodiments, but various modifications and variations of the present invention are possible without departing from the spirit and the scope of the invention.

[1] First Embodiment

[1.1] Configuration of the First Embodiment

Figure 1:
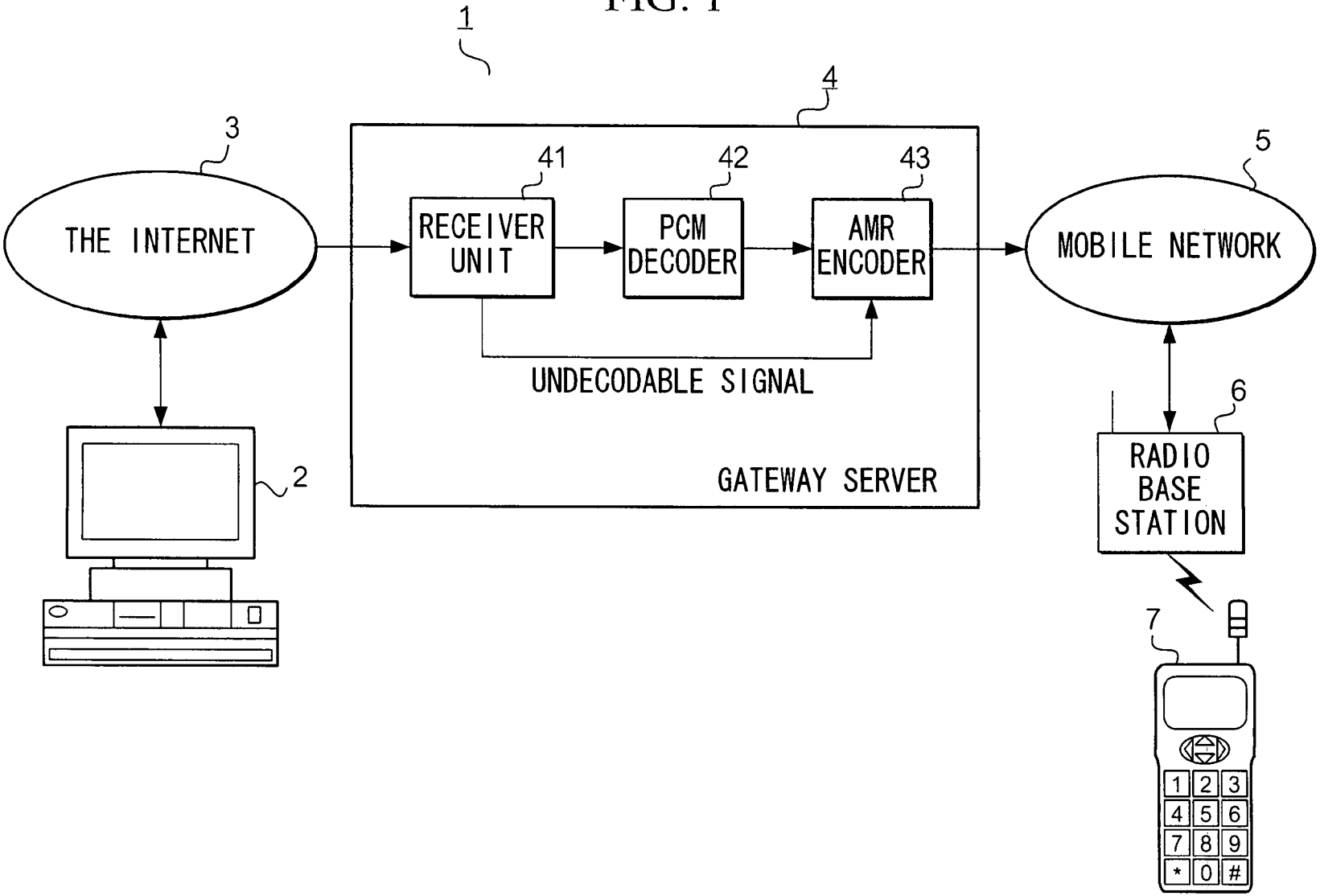
FIG. 1 is a block diagram showing a configuration of a voice communication system 1 of a first embodiment.

FIG. 1 is a block diagram showing a configuration of the voice communication system 1 of the first embodiment.

The voice communication system 1 of the first embodiment comprises as shown in FIG. 1 communication terminals 2, the Internet 3, gateway servers 4, a mobile network 5, radio base stations 6, and mobile terminals 7.

The communication terminal 2 is connected to the Internet 3 and is a device for performing Internet telephone by its user. The communication terminal 2 has a speaker, a microphone, a PCM encoder, a PCM decoder, and an interface for the Internet (all not shown in the drawings). Voice signal input by a user of the communication terminal 2 is PCM-encoded. PCM encoded voice data is encapsulated into one IP packet or more, and sent to the Internet 3. When the communication terminal 2 receives an IP packet from the Internet 3, the PCM voice data in the IP packet is decoded and then output from the speaker. In order to simplify the explanation, in the following description each IP packet has PCM voice data of constant time period.

The mobile terminal 7 is a mobile phone capable of connecting to the gateway server 4 via the mobile network 5.

The mobile terminal 7 comprises a microphone, a speaker, units for performing radio communication with a radio base station 6, units for displaying various information, and units for inputting information such as number or character (all not shown). The mobile terminal 7 also has a built-in microprocessor (not shown) for controlling the above units. The mobile terminal 7 also has an Adaptive Multi-Rate (AMR) codec (coder/decoder). By this codec, the user of the mobile terminal 7 performs communication with AMR encoded voice data with other people. AMR is a multirate codec and a kind of a code excited linear prediction (CELP) codec. AMR has a concealment function. When decoding is not possible due to data loss or crucial bit error, the concealment function compensates the decoded voice signal in question with predicted result based on previously decoded data.

The gateway server 4 is a system for interconnecting the Internet 3 and the mobile network 5. When the gateway server 4 receives AMR encoded voice data frames addressed to the communication terminal 2 on the Internet 3 from the mobile station 7, the gateway server 4 transmits to the communication terminal 2 via the Internet 3 IP packets having PCM voice data corresponding to the above AMR encoded voice data. When the gateway server 4 receives IP packets with PCM voice data addressed to the mobile terminal 7 from the Internet 3, the gateway server 4 converts the PCM voice data into AMR encoded voice data, and transmits to the mobile terminal 7 via the mobile network 5. In this process of propagation of IP packets to the gateway server 4, there is a possibility of loss of IP packets or crucial bit error. In these cases, as AMR encoded voice data corresponding to that defective IP packet, the gateway server 4 puts "No data" data on frame and transmits it to the mobile terminal 7. This "No data" data means that error has occurred in the frame or that the frame is lost and is a subject of the concealment.

The gateway server 4 has a receiver unit 41, a PCM decoder 42, and an AMR encoder 43. They are for receiving IP packets from the Internet 3 and for transmitting the PCM encoded data of the IP packets to the mobile network 5. Shown in FIG. 1 are necessary units for transmitting PCM voice data from the communication terminal 2 on the Internet 3 to the mobile terminal 7. However, in the voice communication system of the first embodiment, it is possible to transmit PCM voice data to the communication terminal 2 from the mobile terminal 7. However, units for transmitting PCM voice data to the communication terminal 2 from the mobile terminal 7 are not shown in the drawings, because the point of the invention is not here.

The receiver unit 41 has an interface for the Internet 3 and receives IP packets transmitted from the communication terminal 2 via the Internet 3. The receiver unit 41 reduces jitter of the received IP packets that is incurred during propagation process, and outputs the IP packets to the PCM decoder 42 in a constant cycle. As a method for reducing propagation delay jitter at the receiver unit 41, using, for example, a buffer in the receiver unit is possible. The received IP packets may be temporally stored in the buffer and be transmitted from the receiver unit 41 to the PCM decoder 42 in a constant cycle.

The receiver unit 41 examines whether or not the received IP packets have bit error. When the IP packet cannot be decoded because of bit error, the receiver unit 41 sends undecodable signal to the AMR encoder 43. When the IP packet to be received is lost in the propagation process, the receiver unit 41 also sends undecodable signal to the AMR encoder 43. However, when IP packets are lost in the propagation process, the receiver unit 41 cannot receive the lost IP packets, so it is not easy to judge whether or not the IP packets are lost. Therefore, the receiver unit 41 judges whether or not IP packets are lost by a certain method. The method may be, for example, to observe time stamps of the received IP packets, and by that to predict when each IP packet comes. In this case, if the predicted time has passed and in addition a predetermined time period has also passed without receiving the IP packet, the IP packet is judged to be lost, and undecodable signal indicating that the IP packet cannot be decoded is sent to the AMR encoder 43.

The PCM decoder 42 extracts PCM voice data from the payload part of the IP packet and PCM-decodes it to output.

The AMR encoder 43 has an interface for the mobile network 5. The AMR encoder 43 AMR-encodes voice data output from the PCM decoder 42 to generate AMR encoded voice data. The AMR encoder 43 transmits the AMR encoded voice data frames to the mobile network 5. In the first embodiment, each frame output from the AMR encoder 43 is in a one-to-one correspondence with each IP packet output from the receiver unit 41.

While the receiver unit 41 outputs undecodable signal, the AMR encoder 43 ignores PCM voice data output from the PCM decoder 42. Instead, the AMR encoder 43 puts "No data" data on frames. The "No data" data is a subject of the concealment.

[1.2] Operation of the First Embodiment

From here, operation of the first embodiment will be described for a case where voice data is transmitted from the communication terminal 2 to the mobile terminal 7. In the first embodiment, it is possible to transmit voice data from the mobile terminal 7 to the communication terminal 2. However, latter operation is not the point of the present invention, so its explanation will be omitted.

Figure 2:
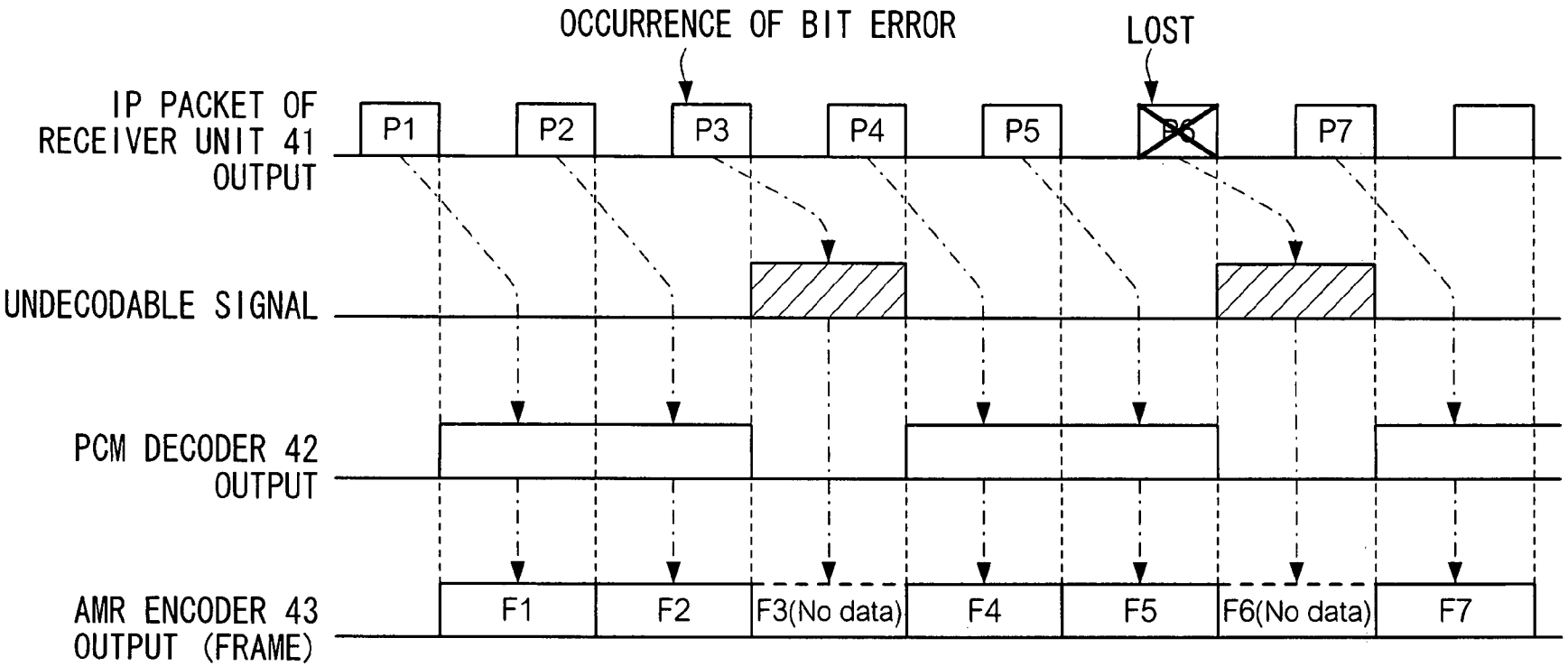
FIG. 2 is a timing chart for process at a gateway server 4.

FIG. 2 is a timing chart for process conducted at the gateway server 4. In FIG. 2, IP packets output from the receiver unit 41 are, after jitter incurred during propagation of IP packets is reduced, output from the receiver unit 41 to the PCM decoder 42 in a constant cycle.

When the gateway server 4 receives the IP packet P1 correctly, the IP packet P1 is output to the PCM decoder 42 at a prescribed moment. Since the IP packet P1 has no error, no undecodable signal is output. When the receiver unit 41 has completed outputting the IP packet P1, the PCM decoder 42 extracts PCM voice data from the payload part of the IP packet P1, and PCM-decodes the extracted PCM voice data to output to the AMR encoder 43. The PCM encoded voice data corresponding to the IP packet P1 output from the PCM decoder 42 is AMR-encoded by the AMR encoder 43 to generate AMR encoded voice data. The AMR encoded voice data frame F1 is transmitted to the mobile network 5.

The gateway server 4 performs the same process to the succeeding IP packet P2 to generate frame F2. The frame F2 is transmitted to the mobile terminal 7 via the mobile network 5.

Next, when the receiver unit 41 receives IP packet P3 having crucial bit error (for example, in the header), the receiver unit 41 sends to the AMR encoder 43 undecodable signal indicating that the IP packet P3 cannot be decoded as shown in FIG. 2.

When the receiver unit 41 has completed outputting the IP packet P3, the PCM decoder 42 starts decoding the IP packet P3. However, since the IP packet P3 has bit error in the packet header, the PCM decoder 42 cannot decode the IP packet P3. As a result, the PCM decoder 42 outputs voice data corresponding to "no sound" for an equivalent period of time to the PCM encoded voice data on one IP packet. As shown in FIG. 2, undecodable signal is output from the receiver unit 41 to the AMR encoder 43 only while the output of the PCM decoder 42 corresponds to "no sound".

Because the receiver unit 41 outputs undecodable signal as shown in FIG. 2, the AMR encoder 43 ignores voice data output from the PCM decoder 42. The AMR encoder 43 puts "No data" data on frames. The "No data" data is a subject of the concealment.

As described above, the AMR encoder 43 sends to the mobile terminal 7 frame F3 with "No data" data on it.

Next, when the gateway server 4 receives faultless IP packets P4 and P5, the gateway server 4 performs the same processing to the IP packets P4 and P5 as done to the IP packet P1.

When the IP packet P6 is lost in the propagation process, the receiver unit 41 cannot receive the IP packet P6, so the receiver unit 41 cannot know loss of the IP packet P6. Therefore, by a certain method the receiver unit 41 judges that the IP packet P6 is lost, and outputs to the AMR encoder 43 undecodable signal indicating that the IP packet P6 cannot be decoded. As a method for determining that IP packets are lost, there is a method, as described above, by which prediction is made when each IP packet comes by observing the time stamps of the received IP packets. In this case, if the predicted time has passed and in addition a predetermined time period has also passed without receiving the IP packet, the IP packet is judged to be lost, and undecodable signal for the IP packet is sent by the receiver unit 41 to the AMR encoder 43. For example, in FIG. 2, because the IP packet P6 is lost, the IP packet P6 is never received even after the predicted time for the IP packet P6 has passed and in addition a predetermined time period has also passed. Therefore, the receiver unit 41 judges that the IP packet P6 is lost, and starts outputting undecodable signal when the predicted hindmost time for the IP packet P6 has passed. The receiver unit 41 keeps outputting the undecodable signal until the receiver unit 41 has completed receiving the IP packet P7.

When the IP packet P6 is lost, the receiver unit 41 does not output the IP packet P6 during time period when the IP packet P6 should be output from the receiver unit 41. Therefore, the PCM decoder 42 cannot perform decoding operation until the next IP packet (in this case P7) is output from the receiver unit 41. As a result, the PCM decoder 42 outputs voice data corresponding to "no sound" for an equivalent period of time to the PCM encoded voice data on one IP packet in the same way done as to the IP packet P3.

The receiver unit 41 outputs undecodable signal during the time period for PCM encoded voice data for the lost IP packet P6 to be output from the PCM decoder 42 as shown in FIG. 2. While the receiver unit 41 outputs undecodable signal, the AMR encoder 43 ignores voice data output from the PCM decoder 42 and puts on frames "No data" data which is subject of the concealment to generate the frame F6.

As described above, the frame F6 generated as "No data" data by the AMR encoder 43 is transmitted to the mobile terminal 7.

The mobile terminal 7 that receives the frames F1 to F6 from the mobile network 5 decodes the frames F1 to F6. In this case, because the frames F3 and F6 have "No data" data, the mobile terminal 7 carries out concealment. By this, voice data (for example, PCM voice data) for the frame F3 is compensated based on the decoded result earlier than the F3, and in the same way voice data (for example, PCM voice data) for the frame F6 is compensated based on the decoded result earlier than the F6.

As described above, when loss of IP packet or bit error in the IP packet occurs in the Internet, by using concealment function of the CODEC used in the mobile network, the gateway server of the first embodiment can compensate voice data for the lost IP packet. Therefore, voice quality degradation can be reduced in real time voice communication.

In the first embodiment, AMR CODEC and PCM CODEC are used as example. However, other CODEC may be used for data that is exchanged between the communication terminal 2 and the gateway server 4. Also, for data that is exchanged between the gateway server 4 and the mobile terminal 7, other CODEC with concealment function may be used.

In the first embodiment, an explanation is given under an assumption that IP packet and frame has a one-to-one correspondence. However, when the length of IP packet and frame are different, it is not possible to make one-to-one correspondence. In this case, when bit error that is too crucial to remedy and decode occurs, voice data for "No sound" output from the PCM decoder 42 for the defective IP packet extends over several frames. In this case, time stamps written in IP packets are used to measure the amount of time of data loss, and frames for this time period are generated to have "No data" data. By this operation, it is possible to prevent the lost IP packet from extending over several frames.

When, for example, one frame has a correspondence to several IP packets, or one IP packet has a correspondence to several frames, that is when correspondence between them is a relation of integral multiples, bringing IP packet into correspondence with frame may be preferable. In this case, when two IP packets P1 and P2 have correspondence to one frame F11 and one of the IP packets (for example P2) is lost, if synchronization has been established between the IP packets and the frame, the frame F11 is generated to have "No data" data. The frames before and after the frame F11 are not effected by the lost IP packet P2.

Also, in the first embodiment, the above explanation is given under an assumption that voice data obtained by the PCM decoder 42 is digital signal. However, if small degradation in voice quality is allowable, PCM decoder 42 may decode into analog voice signal and then send to the AMR encoder 43.

In the first embodiment, PCM encoded voice data transmitted from the communication terminal 2 and received by the gateway server 4 is loaded on IP packet and sent via the Internet 3. However, PCM encoded voice data transmitted from the communication terminal 2 and received by the gateway server 4 may be sent via other communication network system by loading on packet or frame. In this case, when the frame received by the gateway server 4 is lost during the propagation process, generating frame with "No data" data on it may be carried out in the same way as described above. Namely, when the frame sent from the communication terminal 2 to the mobile terminal 7 undergoes a crucial bit error during the propagation to the gateway server 4, the gateway server 4 loads "No data" data instead of the voice data in that frame to generate frame corresponding to the defective frame. Also, frames transmitted by the communication terminal 2 can be lost during the propagation process. In this case, if the predicted time has passed and in addition a predetermined time period has also passed without receiving the frame, the gateway server 4 judges that the frame is lost and loads "No data" data on a frame corresponding to the lost frame to transmit to the mobile terminal 7.

[2] Second Embodiment

The voice communication system of the second embodiment has a similar configuration as the first embodiment shown in FIG. 1. The only deference between the first and second embodiments is a frame generation process at the AMR encoder 43. Therefore, units other than the AMR encoder 43 will not described, since they carries out the same operations as the first embodiment.

From here, an explanation will be given of generation process of frames at the AMR encoder 43

In the second embodiment, the AMR encoder 43 adds a frame number to each frame and transmits the frames to the mobile terminal 2 via the mobile network 5. Loss of IP packet or crucial bit error may happen during the propagation from the communication terminal 2 to the gateway server 4. In this case, the AMR encoder 43 does not transmit frame for the lost IP packet or the error IP packet, skips the frame number for the defective frame, and generates the next frame. For example, in the case shown in FIG. 2, when the IP packet P3 having bit error too crucial to decode is received by the gateway server 4, the AMR encoder 43 skips the frame F3 and transmits the frame F4 to the mobile terminal 2 via the mobile network 5. In the same way, when the IP packet P6 is lost during the propagation process, the AMR encoder 43 skips the frame F6 and transmits the frame F7. Namely, the frames transmitted by the AMR encoder 43 are without the frames F3 and F6.

The mobile terminal 7 receives and decodes the frames F1, F2, F4, F5, and F7. In this case, the mobile terminal 7 judges that the frame numbers 3 and 6 are missing. Hence, the mobile terminal 7 judges that the frames F3 and F6 are lost. Then the mobile terminal 7 carries out concealment. That is, voice data (for example, PCM voice data) for the frame F3 is compensated based on the frames earlier than F3. In the same way, voice data (for example, PCM voice data) for the frame F6 is compensated based on the frames earlier than F6.

As described above, when loss of IP packet occurs in the Internet, the gateway server of the second embodiment does not generate frames for the lost frames. Therefore, a processing complexity laid on the gateway server is decreased.

[3] Third Embodiment

The voice communication system of the third embodiment has a similar configuration as the first embodiment shown in FIG. 1. The only deference between the first and third embodiments is a frame generation process at the AMR encoder 43. Therefore, units other than the AMR encoder 43 will not described, since they carries out the same operations as the first embodiment.

From here, an explanation will be given of generation process of frames at the AMR encoder 43.

In the third embodiment, the AMR encoder 43 sends to the mobile terminal 7 a frame in a constant cycle. Loss of IP packet or crucial bit error may happen during the propagation of IP packets from the communication terminal 2 to the gateway server 4. In this case, the AMR encoder 43 does not transmit any frame for a period when frame for the lost IP packet or the defective IP packet should be sent. For example, in the case shown in FIG. 2, when the IP packet P3 with bit error too crucial to decode is received by the gateway server 4, the AMR encoder 43 does not transmit any frame for the period of the frame F3. In the same way, when the IP packet P6 is lost during the propagation process, the AMR encoder 43 does not transmit any frame for the period of the frame F6.

The mobile terminal 7 receives and decodes the frames F1, F2, F4, F5, and F7. In this case, the mobile terminal 7 does not receive the frame F3 for the period of the frame F3. Also, the mobile terminal 7 does not receive the frame F6 for the period of the frame F6.

When a prescribed time period has passed without receiving the frames F3 and F6 after the predicted moments for the frames F3 and F6, the mobile terminal 7 judges that the frames are lost and carries out concealment. That is, voice data (for example, PCM voice data) for the frame F3 is compensated based on the frames earlier than F3. In the same way, voice data (for example, PCM voice data) for the frame F6 is compensated based on the frames earlier than F6.

As described above, the gateway server of the third embodiment does not assign a number to each frame as in the second embodiment. Therefore, compared to the second embodiment, a processing complexity laid on the gateway server is further decreased.

[4] Fourth Embodiment

[4.1] Configuration of the Fourth Embodiment

Figure 3:
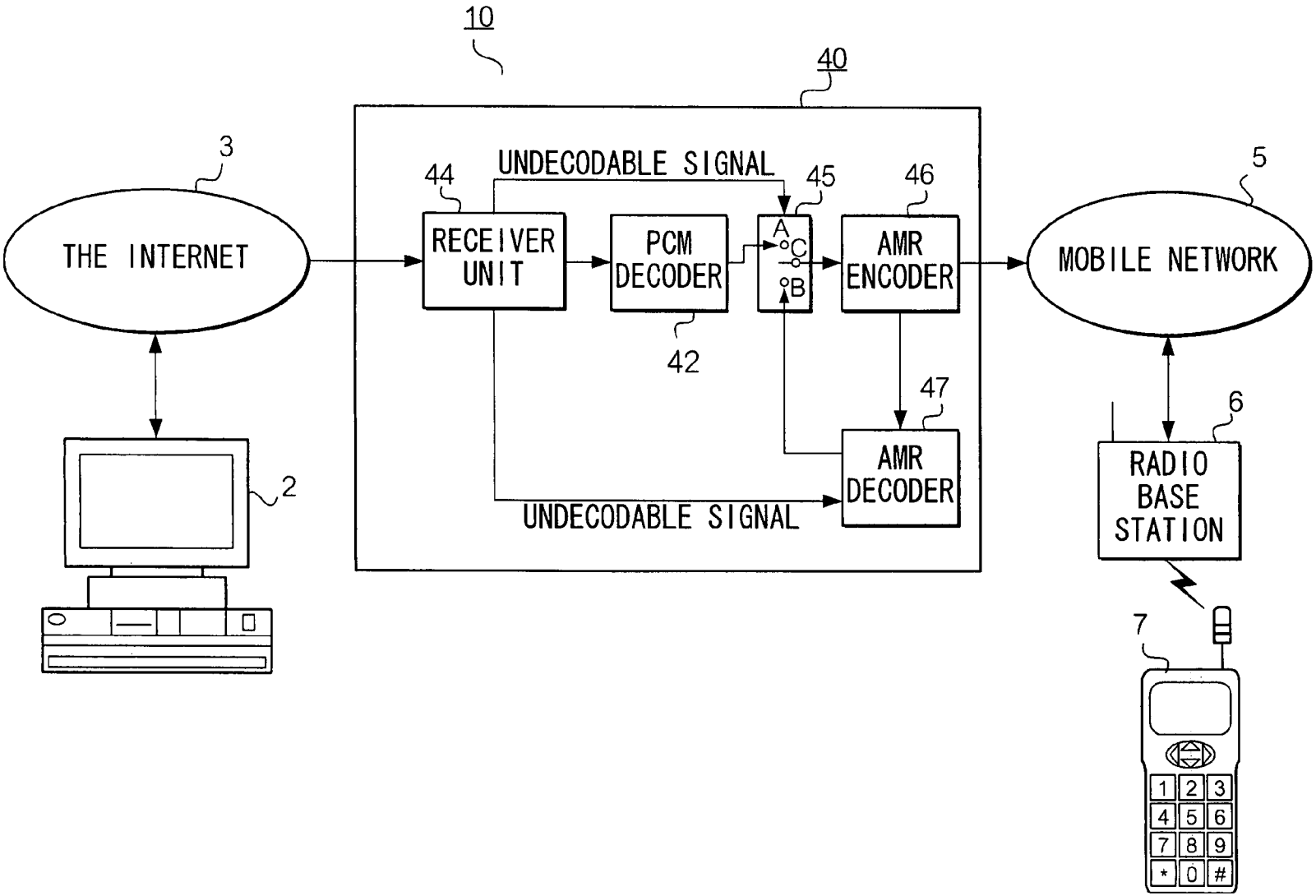
FIG. 3 is a block diagram showing a configuration of a voice communication system 10 of a fourth embodiment.

FIG. 3 is a block diagram showing the configuration of a voice communication system 10 of the fourth embodiment. In FIG. 3, the same reference numerals are used for the corresponding units in FIG. 1.

In the fourth embodiment, the gateway server 40 comprises a receiver unit 44, a PCM decoder 42, a switch 45, an AMR encoder 46, and an AMR decoder 47.

The receiver unit 44 has an interface for the Internet as in the first embodiment, and receives IP packets transmitted from the communication terminal 2 via the Internet 3. The receiver unit 44, after reducing jitters incurred during propagation of IP packets, outputs the IP packets to the PCM decoder 42 in a constant cycle. The receiver unit 44 examines whether or not this received IP packet has bit error. When the IP packet cannot be decoded or the IP packet is lost, the receiver unit 44 sends to the AMR decoder 47 undecodable signal indicating that the IP packets cannot be decoded. Methods for reducing propagation delay jitter of the IP packet received by the receiver unit 44 and for determining whether or not IP packets are lost are the same as in the first embodiment. Therefore, explanation for the methods will not be given. The receiver unit 44 in the fourth embodiment outputs the undecodable signal also to the switch 45.

The switch 45 selects the terminal B only while the switch 45 receives undecodable signal. Otherwise, the switch 45 selects the terminal A. That is, when the switch 45 receives undecodable signal from the receiver unit 44, the switch 45 outputs to the AMR encoder 46 voice data that is input from the AMR decoder 47, in other case, the switch 45 outputs to the AMR encoder 46 voice data that is input from the PCM decoder 42.

In the same way as in FIG. 1, the AMR encoder 46 encodes voice data input via the switch 45 to generate frames. The AMR encoder 46 transmits generated frames to the AMR decoder 47 and at the same time to the mobile terminal 7 via the mobile network 5.

The AMR decoder 47 decodes frames input from the AMR encoder 46 to obtain voice data and outputs it to the terminal B of the switch 45. The AMR decoder 47 performs concealment while the AMR decoder receives undecodable signal from the receiver unit 44. By this and based on the decoded results of the earlier frame than the undecodable frame, voice data for the frame in question is compensated.

[4.2] Operation of the Fourth Embodiment

From here, operation of the fourth embodiment will be described for a case where voice data is transmitted from the communication terminal 2 to the mobile terminal 7. In the fourth embodiment, it is possible to transmit voice data from the mobile terminal 7 to the communication terminal 2. However, this operation is not the point of the present invention, so its explanation will not given.

Figure 4:
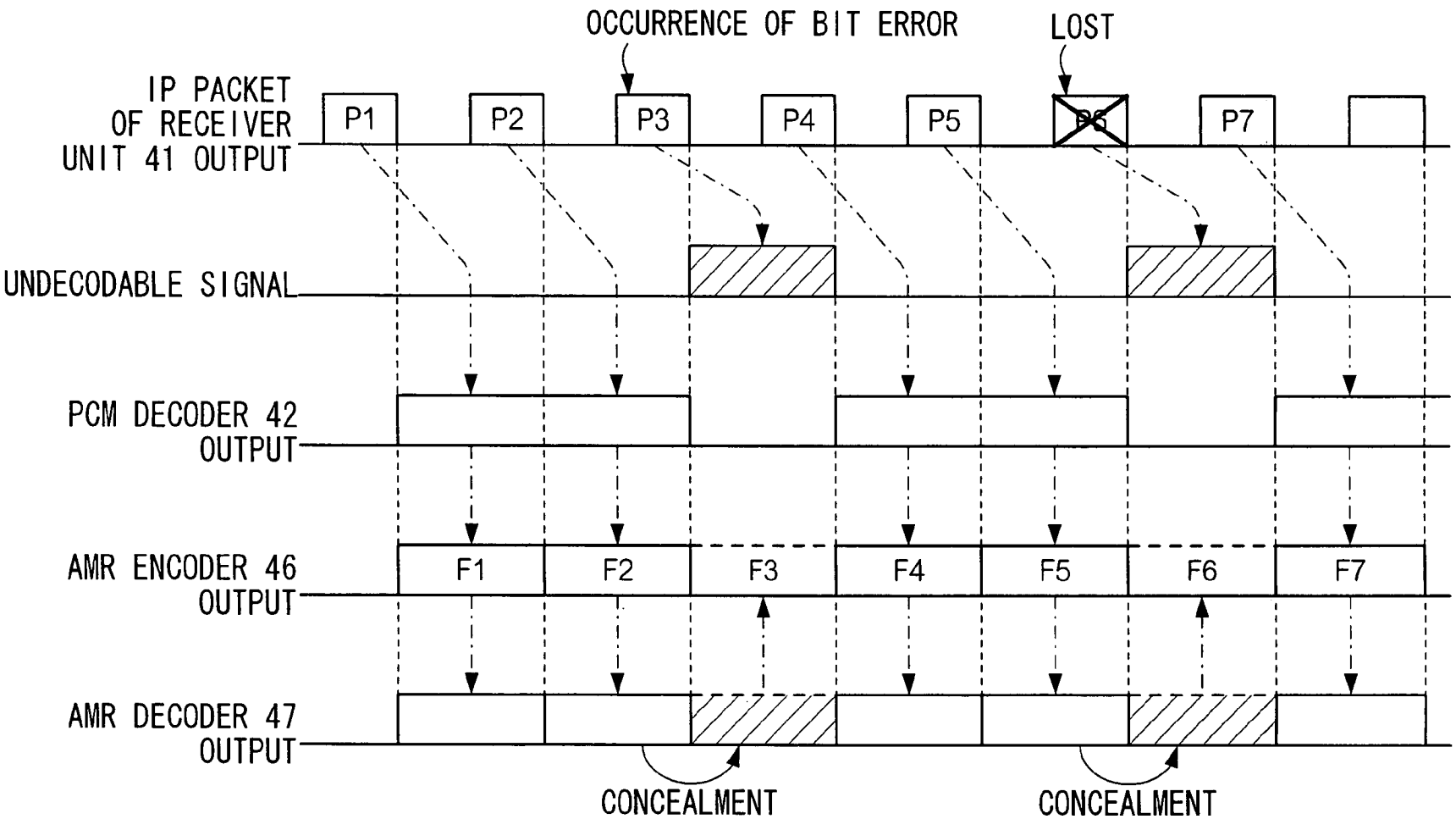
FIG. 4 is a timing chart for process at a gateway server 40.

FIG. 4 is a timing chart for process conducted at a gateway server 40. In FIG. 4, IP packets output from the receiver unit 44 are, after jitters incurred during propagation of IP packets are reduced, output to the PCM decoder 42 in a constant cycle.

When the gateway server 40 receives the IP packet P1 correctly, the IP packet P1 is output from the receiver unit 44 to the PCM decoder 42. Since the IP packet P1 has no error, no undecodable signal is output by the receiver unit 44. When the receiver unit 44 has completed outputting the IP packet P1, the PCM decoder 42 extracts PCM voice data from the payload part of the IP packet P1, PCM-decodes the extracted PCM voice data, and outputs it to the AMR encoder 46 via the terminal A of the switch 45. The voice data corresponding to the IP packet P1 output from the PCM decoder 42 is AMR-encoded by the AMR encoder 46 to generate AMR encoded voice data frame F1. The AMR encoded voice data frame F1 is transmitted to the mobile terminal 7 via the mobile network 5. The frame F1 is also output to the AMR decoder 47, and the AMR encoded voice data frame F1 is decoded by the AMR decoder 47.

The gateway server 40 performs the same processing to the next IP packet P2 to generate frame F2, and transmits the frame F2 to the mobile terminal 7.

Next, when the receiver unit 44 receives IP packet P3 with crucial bit error (for example, in the header), the receiver unit 44 sends to the AMR decoder 47 and to the switch 45 undecodable signal indicating that the IP packet P3 cannot be decoded as shown in FIG. 4.

When the receiver unit 44 has completed outputting the IP packet P3, the PCM decoder 42 starts decoding the IP packet P3. However, the IP packet P3 has bit error (for example in the packet header), so the PCM decoder 42 cannot decode the IP packet P3. As a result, voice data corresponding to "no sound" is output from the PCM decoder 42 to the terminal A of the switch 45 for an equivalent period of time to the PCM encoded voice data on one IP packet.

While the AMR decoder 47 receives undecodable signal from the receiver unit 44, the AMR decoder 47 ignores frames output from the AMR encoder 46 and performs concealment. By this, voice data for the frame F3 is compensated based on the decoded results earlier than frame F3. That is, the AMR decoder 47 can output to the terminal B newly-created voice data by the concealment operation corresponding to the frame F3 in synchronous with the output of voice data corresponding to the IP packet P3 from the PCM decoder 42 to the terminal A.

While the switch 45 receives at the terminal A voice data for the IP packet P3 from the PCM decoder 42 and at the terminal B voice data for the frame F3, undecodable signal is also input to the switch 45 from the receiver unit 44. Therefore, the switch 45 selects the terminal B to output to the AMR encoder 46 the voice data corresponding to the frame F3 obtained by the concealment operation by the AMR decoder 47. Therefore, voice data corresponding to "no sound" output from the PCM decoder 42 is not input to the AMR encoder 46.

As described, the voice data is first compensated by concealment operation by the AMR decoder 47, then encoded by the AMR encoder 46 into AMR encoded voice data frame F3, and transmitted to the mobile terminal 7.

Next, when the gateway server 40 receives faultless IP packets P4 and P5, the gateway server 40 performs the same processing to the IP packets P4 and P5 as done to the IP packet P1.

When the IP packet P6 is lost during the propagation process, the receiver unit 44 cannot receive the IP packet P6 and cannot determine whether or not the IP packet P6 is lost. Therefore, by a certain method the receiver unit 44 makes a judgement that the IP packet P6 is lost. Then the receiver unit 44 outputs to the AMR decoder 47 and to the switch 45 undecodable signal for the IP packet P6. The method for determining the loss of the IP packet P6 is the same as that done by the receiver unit 41 of the first embodiment. Therefore, explanation for the method will not given here.

The receiver unit 44 does not output IP packet P6 during a time period when the IP packet P6 should be output. Therefore, the PCM decoder 42 cannot perform decoding operation until the next IP packet (in this case P7) is output from the receiver unit 44. As a result, voice data corresponding to "no sound" is output from the PCM decoder 42 to the terminal A for an equivalent period of time to the PCM voice data on one IP packet. While the receiver unit 44 outputs undecodable signal, the AMR decoder 47 ignores frames output from the AMR encoder 46 and performs concealment. By this, voice data for the frame F6 is compensated based on the decoded results prior to frame F6, and output to the terminal B.

While the switch 45 receives at the terminal A voice data for "no sound" from the PCM decoder 42 and at the terminal B voice data for the frame F6 obtained by the concealment operation by the AMR decoder 47, undecodable signal is input to the switch 45 from the receiver unit 44. Therefore, the switch 45 selects the terminal B to output to the AMR encoder 46 the voice data output from the AMR decoder 47. The AMR encoder 46 encodes the voice data output from the AMR decoder 47 via the switch 45 into AMR encoded voice data frame F6 and transmits to the mobile terminal 7.

As described above, in the voice communication system of the fourth embodiment, even when bit error in IP packet has occurred in the Internet, data loaded on the packet is compensated by performing concealment in the gateway server and thereby frame can be generated. Therefore, it becomes unnecessary to use concealment function of an AMR codec on the mobile terminal. Also, decoder in mobile terminal does not need to have concealment function. As a result, voice quality variation due to performance of codec on the mobile terminal can be reduced.

[5] Fifth Embodiment

In the fifth embodiment, voice communication terminal suitable for real time voice communication via a network that uses an encoding system without concealment function will be described.

Figure 5:
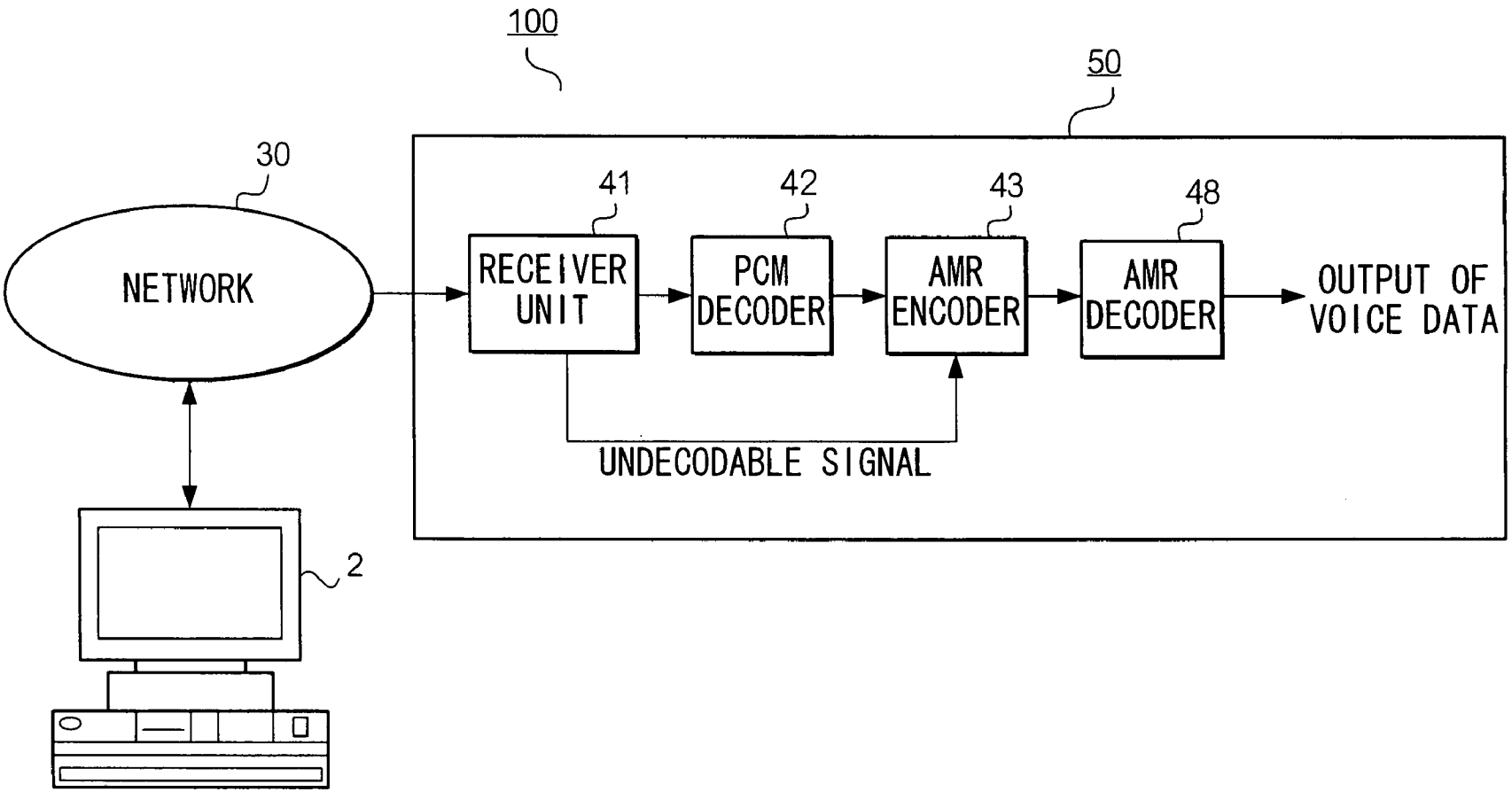
FIG. 5 is a block diagram showing a configuration of a voice communication system 100 of a fifth embodiment.

FIG. 5 is a block diagram showing the configuration of the voice communication system of the fifth embodiment. In FIG. 5, the same reference numerals are used for the corresponding units in FIG. 1.

The voice communication system 100 of the fifth embodiment comprises as shown in FIG. 5 communication terminals 2, a network 30, and voice communication terminals 50.

When the voice communication terminal 50 receives IP packets with PCM voice data on them from the network 30, in a case where there is crucial bit error in the received IP packets incurred in the propagation process, the voice communication terminal 50 of the fifth embodiment performs concealment.

The AMR decoder 48 is a device that decodes the frame input from the AMR encoder 43 to obtain voice data. When the frame output from the AMR encoder 43 has "No data" data on it, the AMR decoder 48 performs concealment by using the decoded result of the earlier frames.

Figure 6:
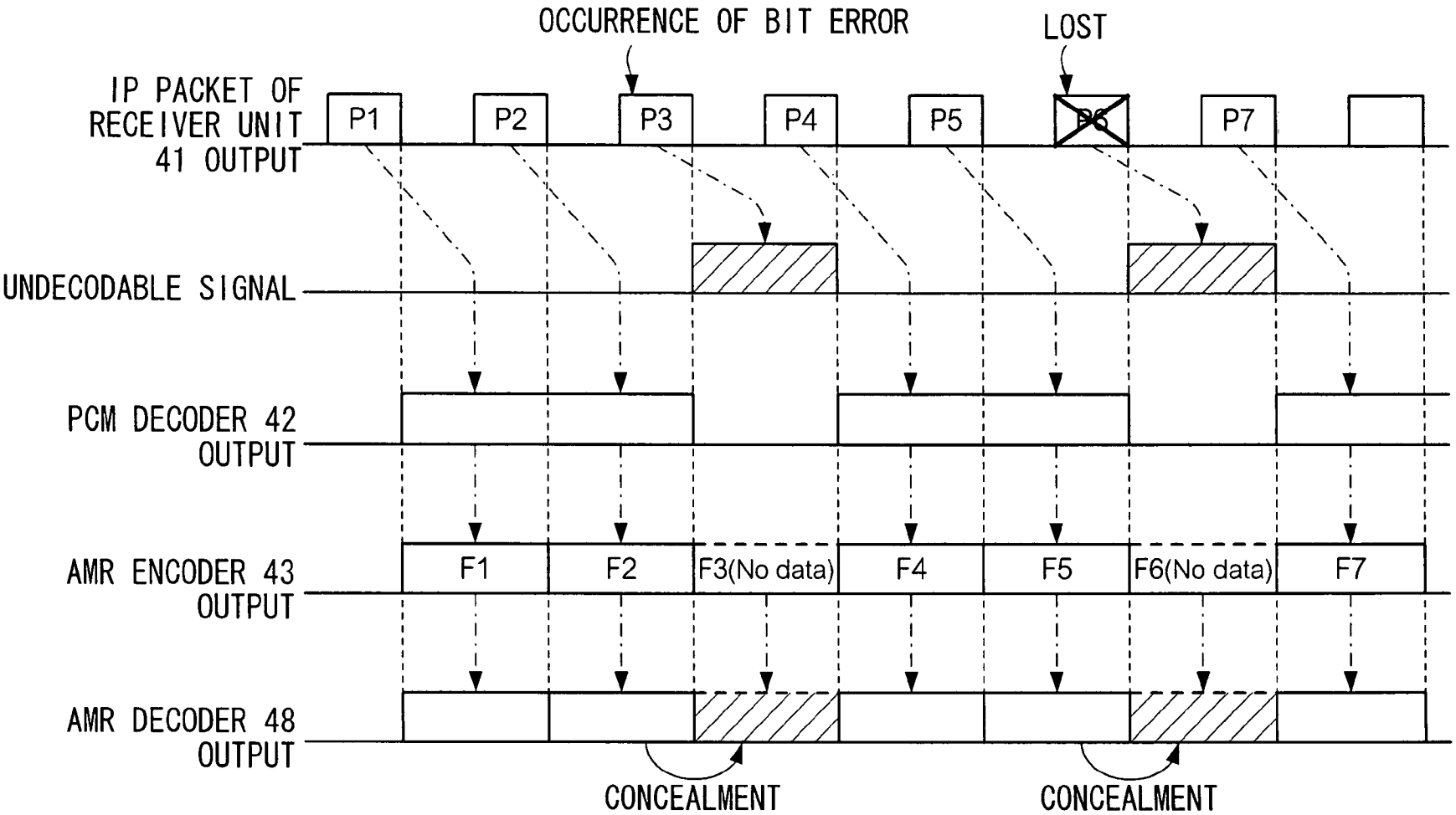
FIG. 6 is a timing chart for process at a voice communication terminal 50.

With reference to the timing chart shown in FIG. 6, operation of the fifth embodiment will be described.

When the receiver unit 41 receives IP packets from the network 30, after reducing jitters incurred during propagation of IP packets, the receiver unit 41 outputs the IP packets to the PCM decoder 42 in a constant cycle. The receiver unit 41 also judges whether or not the received IP packets have bit errors. When the voice communication terminal 50 receives the IP packet P3 with errors so bad that decoding is not possible, the receiver unit 41 outputs undecodable signal to the AMR encoder 43. The undecodable signal output from the receiver unit 41 to the AMR encoder 43 is the same as in the first embodiment. Therefore, explanation for the undecodable signal will not given.

When the IP packet P6 is lost during the propagation process, the receiver unit 41 cannot receive the IP packet P6 and cannot determine whether or not the IP packet P6 is lost. Therefore, by a certain method the receiver unit 41 makes a judgment that the IP packet P6 is lost, and outputs to the AMR encoder 43 undecodable signal indicating that the IP packet P6 cannot be decoded. The method for determining by the receiver unit 41 the loss of the IP packet P6 is the same as that of the first embodiment. Therefore, explanation for the method will not given here.

In the same way as in the first embodiment, the PCM decoder 42 decodes the PCM voice data extracted from the payload part of the IP packet which is output from the receiver unit 41 in a constant cycle. The decoded PCM voice data is output to the AMR encoder 43. When the voice communication terminal 50 receives the IP packet P3 with errors so bad that decoding is not possible, the PCM decoder 42 outputs voice data corresponding to "no sound" for an equivalent period of time to the PCM voice data on one IP packet. When the IP packet P6 is lost in the propagation process, the PCM decoder 42 outputs voice data corresponding to "no sound" in the same way as the IP packet P3.

In the same way as in the first embodiment, the AMR encoder 43 AMR-encodes voice data output from the PCM decoder 42 to generate AMR encoded voice data. When loss of IP packet or crucial bit error too crucial to correctly decode has occurred in the propagation process (P3 and P6 in FIG. 6), the receiver unit 41 outputs undecodable signal to the AMR encoder 43. By this, the AMR encoder 43 ignores the output from the PCM decoder 42 and generates frames F3 and F6 having "No data" data as replacements for AMR encoded voice data.

The AMR decoder 48 decodes the frames generated by the AMR encoder 43 to output. In this explanation, among the frames output by the AMR encoder 43, the frames F3 and F6 have "No data" data. Therefore, the AMR decoder 48 performs concealment to compensate voice data (for example, PCM voice data) corresponding to the frame F3 based on the decoded result earlier than the frame F3, and output the result. Also, for the frame F6, voice data (for example, PCM voice data) corresponding to the frame F6 is compensated based on the decoded result earlier than the frame F6, and the result is output.

As described above, by the voice communication terminal of the fifth embodiment, even when voice communication is carried out through a network that uses an encoding system without a concealment function, concealment operation is possible in a voice communication terminal. Therefore, when IP packet is lost in the network, voice data (for example, PCM voice data) included in the lost IP packet can be compensated. Hence, real time voice communication can be carried out with the least or no degradation of voice quality.

In the above embodiments, AMR that has predictive-coding function is used for encoding. However, it is possible to use other encoding that does not have predictive-coding function. In this case, concealment may be achieved, for example, by inserting noise whose signal strength is increased almost to that of voice signal.

The present invention can be embodied so as to record the program that executes the voice processing, which is performed by the voice processing device in the gateway server as described in the embodiments, on storage media readable by computers, and deliver the media to users, or provide the program to users through electronic communication circuits.

What is claimed is:

1. A data relaying device that receives data over a wired network and sends the data over a wireless network, comprising:

a receiver that receives from the wired network data in packets encoded under a PCM coding scheme, wherein the receiver examines the received data to detect and distinguish any undecodable packet from decodable packets and outputs an undecodable signal when it finds an undecodable packet;

a PCM decoder that decodes data in the decodable packets under the PCM coding scheme;

an AMR (adaptive Multi-Rate) encoder that encodes under an AMR coding scheme the decoded data from the PCM decoder and outputs encoded data in frames in which the AMR encoder, when it receives the undecodable signal from the receiver, stores an indicia of undecodable data in a frame corresponding to the undecodable packet indicated by the outputted undecodable signal from the receiver identified by the undecodable signal outputted from the receiver; and a transmitter that transmits to the wireless network the frames of data from the AMR encoder.

2. A data relaying device that receives data over a first network and sends the data over a second network, comprising:

a receiver that receives data in packets encoded under a first coding scheme adopted for data transmission over the first network, wherein the receiver examines the received data to detect and distinguish any undecodable packet from decodable packets;

a first decoder that decodes data in the decodable packets under the first coding scheme;

a first encoder that performs encoding under a second coding scheme adopted for data transmission over the second network;

a second decoder that performs decoding under the second coding scheme on encoded data from the first encoder;

a switch that supplies decoded data from the first decoder to the first encoder for encoding when the decodable packets are detected, whereas supplying the decoded data of a past decodable packet from the second decoder to the first encoder for encoding when the undecodable packet is detected; and a transmitter that transmits the encoded data from the first encoder in frames over the second network.

3. A data relaying device that receives data over a first network and sends the data over a second network, comprising:

a receiver that receives from the first network data in packets encoded under a first coding scheme, which does not support an error concealment operation, wherein the receiver examines the received data to detect and distinguish any undecodable packet from decodable packets and outputs an undecodable signal when it finds an undecodable packet;

a decoder that decodes data in the decodable packets under the first coding scheme;

an encoder that encodes the decoded data from the decoder under a second coding scheme, which supports an error concealment operation, and outputs encoded data in frames in which the encoder, when it receives the undecodable signal from the receiver, stores an indicia of undecodable data in a indicated by the outputted undecodable signal from the receiver frame corresponding to the undecodable packet identified by the undecodable signal outputted from the receiver; and a transmitter that transmits to the second network the frames of data from the encoder.

4. A data relaying device that receives data over a first network and sends the data over a second network, comprising:

a receiver that receives data in packets encoded under a first coding scheme adopted for data transmission over the first network, wherein the receiver examines the received data to detect and distinguish any undecodable packet from decodable packets;

a first decoder that decodes data in the decodable packets under the first coding scheme;

a first encoder that performs encoding under a second coding scheme adopted for data transmission over the second network;

a second decoder that performs decoding under the second coding scheme on encoded data from the first encoder;

a switch that supplies decoded data from the first decoder to the first encoder for encoding when the decodable packets are detected, whereas supplying decoded data of a past decodable packet from the second decoder to the first encoder for encoding when the undecodable packet is detected; and a transmitter that transmits the encoded data from the first encoder in frames over the second network.

* * * * *